US009975036B2

(12) United States Patent
Martino et al.

(10) Patent No.: US 9,975,036 B2
(45) Date of Patent: *May 22, 2018

(54) DELIVERY SHOE WITH MASKING CAPABILITY FOR CARD BACKS

(71) Applicants: Brittney Rose Martino, Las Vegas, NV (US); Norbert Reiner, Las Vegas, NV (US)

(72) Inventors: Brittney Rose Martino, Las Vegas, NV (US); Norbert Reiner, Las Vegas, NV (US)

( * ) Notice: Subject to any disclaimer, the term of this patent is extended or adjusted under 35 U.S.C. 154(b) by 132 days.

This patent is subject to a terminal disclaimer.

(21) Appl. No.: 15/161,205

(22) Filed: May 21, 2016

(65) Prior Publication Data

US 2017/0173448 A1 Jun. 22, 2017

Related U.S. Application Data

(63) Continuation-in-part of application No. 14/977,933, filed on Dec. 22, 2015, now Pat. No. 9,895,599.

(51) Int. Cl.

| | |
|---|---|
| ***A63F 1/12*** | (2006.01) |
| ***A63F 1/10*** | (2006.01) |
| ***F21V 33/00*** | (2006.01) |
| ***F21V 5/04*** | (2006.01) |
| *F21Y 115/10* | (2016.01) |

(52) U.S. Cl.

CPC ..... *A63F 1/10* (2013.01); *F21V 5/04* (2013.01); *F21V 33/008* (2013.01); *A63F 2250/58* (2013.01); *F21Y 2115/10* (2016.08)

(58) Field of Classification Search

CPC ..... A63F 1/12

USPC ..... 273/149 R

See application file for complete search history.

(56) References Cited

U.S. PATENT DOCUMENTS

| | | | | |
|---|---|---|---|---|
| 6,403,908 | B2 * | 6/2002 | Stardust | A63F 1/14 209/547 |
| 6,629,894 | B1 * | 10/2003 | Purton | A63F 1/06 273/149 R |
| 7,593,544 | B2 * | 9/2009 | Downs, III | A63F 1/14 273/148 A |
| 7,933,444 | B2 * | 4/2011 | Downs, III | A63F 1/14 273/148 A |
| 7,967,672 | B2 * | 6/2011 | Shigeta | A63F 1/18 235/468 |

(Continued)

*Primary Examiner* — John E Simms, Jr.

*Assistant Examiner* — Dolores Collins

(74) *Attorney, Agent, or Firm* — Mark A. Litman & Assoc., P.A.

(57) ABSTRACT

A method of using a dealer shoe that is configured to provide access to and removal of playing cards from within the dealer shoe includes:

a base, a front plate forming a lower gap with the plate through which individual playing cards can pass, a top, and opposed sides joining the base, top, two sides and the front plate to form a card-carrying cavity. The front plate further is associated with a light producing element configured to shine light (e.g., in patterns, in colors, and the like) over a back of a first playing card extending out of the lower gap; and the wavelength and intensity and qualities of the shone light being sufficient to reduce optical contrast of different colors and/or shades on the back of the first playing card or otherwise disrupt optical viewing of printed images on the backs of playing cards.

30 Claims, 11 Drawing Sheets

(56) References Cited

U.S. PATENT DOCUMENTS

| | | | | |
|---|---|---|---|---|
| 8,070,574 | B2 * | 12/2011 | Grauzer | A63F 1/12 273/149 R |
| 8,170,323 | B2 * | 5/2012 | Downs, III | A63F 1/14 273/148 A |
| 8,221,244 | B2 * | 7/2012 | French | G07F 17/32 463/11 |
| 8,727,350 | B2 * | 5/2014 | Flynn | A63F 1/14 273/149 R |
| 8,777,710 | B2 * | 7/2014 | Grauzer | A63F 1/12 273/149 R |
| 8,969,802 | B1 * | 3/2015 | Blazevic | A63F 1/12 250/330 |
| 9,539,495 | B2 * | 1/2017 | Scheper | A63F 1/14 |
| 2009/0054161 | A1 * | 2/2009 | Schubert | A63F 1/14 463/47 |
| 2010/0038849 | A1 * | 2/2010 | Scheper | A63F 1/14 273/149 R |
| 2011/0198805 | A1 * | 8/2011 | Downs, III | A63F 1/14 273/149 R |
| 2014/0042697 | A1 * | 2/2014 | Berube | A63F 1/14 273/149 R |
| 2014/0347471 | A1 * | 11/2014 | Blazevic | G01N 21/8806 348/128 |
| 2015/0265909 | A1 * | 9/2015 | Schubert | A63F 1/14 273/149 R |

* cited by examiner

DELIVERY SHOE WITH MASKING CAPABILITY FOR CARD BACKS

RELATED APPLICATION DATA

This application claims priority under 35 U.S.C. 120 as a Continuation-in-Part of U.S. patent application Ser. No. 14/977,933, filed 22 Dec. 2015 having the title of "DELIVERY SHOE WITH MASKING CAPABILITY FOR CARD BACKS."

BACKGROUND OF THE INVENTION

1. Field of the Invention

The present invention relates to the field of playing card delivery systems, and particularly dealing shoes that mask all card backs, and only after manually driven delivery of playing cards is any back surface of a playing card disclosed without masking of the card back.

2. Background of the Art

Playing cards are used in many social and entertainment games, and are most often used in casinos in casino table wagering games. It is important to the fairness of the games that pre-knowledge of the cards is not available to players. Numerous illegal efforts are made to give individuals or players an unfair advantage by marking or daubing playing cards with marks on backs or edges of playing cards that indicate the rank and/or suit of cards. Most of these techniques are overcome by careful inspection of playing cards, even by mechanical/electromagnetic imaging means, as in U.S. Pat. No. 8,969,802 and Published US Patent Application Publication No. 20140347471 (Blazevic).

It has been known for some time that when playing cards are cut from sheet with patterned backs, the cuts were unevenly placed on the patterns, and the relative position on the cuts could be read over time as indicative of the position of the card on the original sheet, which in turn was indicative of the rank and/or suit of the card's face.

To overcome this issue, a white border was expanded around the sections on the back pattern relatively corresponding to the expected position of the card values on the front side of the card faces. Because printing alignment is not perfect, distances from edges across the white borders also varies sufficiently as to offer similar pre-knowledge of rank and suit values from the backs of playing cards as the edges extend out of the dealer's shoe.

It has become desirable to find a better way of preventing early viewing of the backs of playing cards as they are dealt that might enable preview of card ranks.

Published US Patent Application Nos. 20150265909 and 20090054161 (Schubert) and U.S. Pat. Nos. 8,777,710 and 8,070,574 (Grauzer) discloses a playing card delivery shoe used in the play of the casino table card game of blackjack.

The shoe may include an area for receiving a first set of playing cards, a first card mover that moves playing cards from the first set of playing cards to a playing card staging area, a second playing card mover that moves playing cards from the playing card staging area to a delivery area, and playing card-reading sensors that read at least one playing card value of each playing card separately after each playing card has been removed from the area for receiving the first set of playing cards and before removal from the playing card delivery area. A processor analyzes the data and displays certain game-related data on a display device.

Methods of providing cards to a dealer in a casino table card game of blackjack are disclosed.

Published US Patent Application No. 20140327208 (Grauzer) discloses card-handling devices including a card-holding area and a card output shoe. The card output shoe includes a card-way for passage of cards from the card-holding area into a dealing-ready area. A movable gate is positioned between the card-way and the dealing-ready area to prevent cards in the dealing-ready area from re-entering the card-way. Card shufflers include a gate mounted to allow movement of randomized groups of cards from card-receiving compartments to proximate a terminal end plate of a card output shoe and to block movement of cards in an opposite direction. In related methods of moving cards, card movement through the card-way to the dealing-ready position is allowed by a movable gate and card movement from the dealing-ready position into the card-way is prevented by the movable gate.

Published US Patent Application No. 20120091656 (Blaha) discloses card handling systems including shuffling devices, shoe devices, and a card transfer system for automatically transferring cards from the shuffling device into the shoe device. Shuffling devices may include a divider configured to contact at least one card positioned within a compartment of the shuffling device. Shoe devices may include a card loading system for loading cards into a card storage area through an opening in a base of the shoe device. Methods of providing cards during a casino table game play include identifying card information including a rank and a suit of each card in a shuffling device and a shoe device and transporting cards from the shuffling device to the shoe device.

Published US Patent Application No. 20110198805 (Downs III) discloses a playing card delivery shoe that is used in the play of the casino table card game of baccarat or blackjack or any game where cards are pulled one at a time from the shoe. The apparatus comprises a reader or an imager that scans lines bisecting the image at spaced intervals. The scanning occurs on playing cards in at least the region where suit and rank symbols are provided. The scanner output is a series of voltages that are converted to binary information. This binary information is compared to stored binary information to determine rank and suit. The upper surface of the output end of the shoe contains a partial barrier for cards being scanned. The partial barrier has an elevated surface and limits a size of a pathway so that only one card can be removed at a time.

U.S. Pat. No. 4,750,743 (Nicoletti) describes the use of a mechanical card dispensing means to advance cards at least part way out of the shoe. The described invention is for a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advancing means contacting the trailing card and adapted to urge the stacked cards down the inclined floor; card dispensing means positioned proximate the front wall and adapted to dispense a single card at a time.

Published US Patent Application No. 20100213668 (Dickinson) discloses an automatic card shuffler includes a card input unit, card ejection unit, card separation and delivery unit and card collection unit. A card ejection unit ejects cards in a singular fashion from a stack of cards placed into the input unit. The ejected cards are passed through a dynamic de-doubler that prevents more than a pre-established number of cards from passing through. The dynamic de-doubler is able to shift positions to accommodate card that are bent, impacted by environmental conditions and otherwise worn. The cards are ejected to a stop arm maintaining the entrance to the card separation unit. Upon processor command, the stop arm raises to allow a plurality of cards to pass under to the card separation and delivery unit. A series of rotating belts and rollers act to separate the cards and propel them individually to the collection unit. A floating gate slightly forward of the stop arm dictates that a minimum number of cards are managed simultaneously. The shuffler is controlled by a processing unit in communication with multiple internal sensors.

Published US Patent Application Nos. 20200213667 and 20050012269 (Grauzer) discloses a distinct dealing shoe having no shuffling functionality receives shuffled, randomized or ordered group of cards. The cards may be mechanically moved one at a time from a receiving area for the deck to a buffer area where more than one card is temporarily stored. The cards in the buffer area are then mechanically moved to a card delivery area where the cards may be manually removed, one-at-a-time, by a dealer. The cards are read one-at-a-time inside of the dealing shoe, either before the buffer area or after leaving the buffer area, but preferably before the cards are being manually removed from the card delivery area. The information from the card reading may be used for game tracking, hand tracking, player information, and other security issues at casino table card games.

U.S. Pat. No. 4,659,082 (Greenberg) discloses a Monte Verde card dispenser of shoe that simulates a card shoe containing a playing card deck or near infinite length. The card dispenser includes a rotary carousel containing a plurality of card carrying compartments around the periphery thereof. The cards area injected with the carousel from the input hopper and ejected from the carousel into an output hopper for use by the dealer.

U.S. Pat. No. 6,402,142 (Warren) discloses an apparatus for dealing cards at a casino gaming table. The apparatus, or dealer shoe, has a base and a card roller. The base holds a deck or decks of cards while in use. The card roller is movably connected to the base and applies a downward pressure on the cards in the base so that they may be removed from the base. The card roller is moved into a resting place within the base when cards are removed to be shuffled, facilitating removal and insertion of the cards. By resting in the base, the card roller is protected from damage.

These technologies are not considered the best or most cost-effective solutions to the present issues, but are all incorporated herein in their entirety by reference.

SUMMARY OF THE INVENTION

A method of using a dealer shoe that is configured to provide access to and removal of playing cards from within the dealer shoe includes:

a base, a front plate forming a lower gap with the plate through which individual playing cards can pass, a top, and opposed sides joining the base, top, two sides and the front plate to form a card-carrying cavity. The front plate further has a light producing element configured to shine light over a back of a first playing card extending out of the lower gap; and the wavelength and intensity of the shone light being sufficient to reduce optical contrast of different colors and/or shades on the back of the first playing card.

DETAILED DESCRIPTION OF THE INVENTION

Figure 1A:
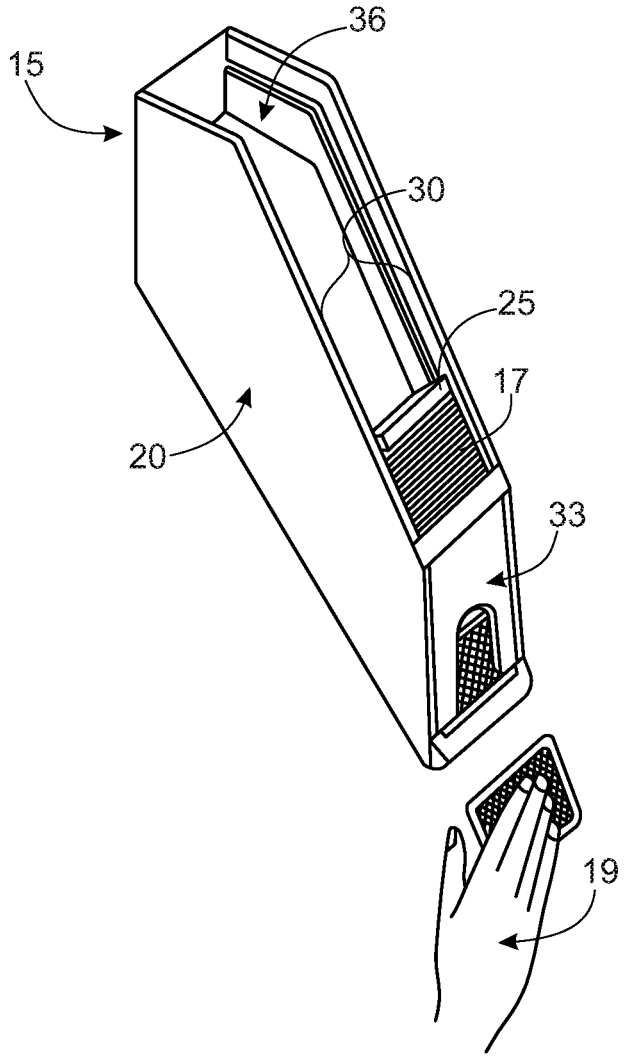
PRIOR ART FIG. 1A
FIG. 1A shows a prior art embodiments (U.S. Pat. No. 6,402,142) of a dealer shoe while in use.

A method for providing access to and removal of playing cards in a dealer shoe, may include the steps of:

placing one or more decks of cards (e.g., playing cards having suit and rank on a face and an image or pattern with or without white edging on their backs) in a dealer shoe comprised of a base, front plate forming a lower gap with the plate through which individual playing cards can pass, a top, and opposed sides joining the base, top, two sides and the front plate. The front plate further has a light producing element (e.g., LED panels or bulbs, fluorescent bulbs, incandescent bulbs, semiconductor light emitters and the like) configured to shine visible light over a back of a first playing card extending out of the lower gap. The purpose of the light(s) is to overlay colors or tones and white background on the back of the playing card.

The wavelength, pattern (e.g., discontinuous distribution of light) and intensity of the shone light being sufficient to reduce optical contrast of different colors and/or shades on the back of the first playing card. The pattern can disrupt visible perception of the actual pattern printed on the back of the playing card. The emitted/projected pattern may be significantly different from the printed pattern, or only slightly vary from the printed pattern to confuse optical/visible reading of the printed image. Where the back of the card, for example, has red-and-white colors, the emitted light should be sufficiently red to color and blend the white into the red; when the back of the card is greenish, the emitted light should sufficiently match the green, and similarly with single colors or multiple colors on the backs of the cards and the emitters. The method and dealer shoe may be practiced wherein the shone light is emitted from the top of the shoe over the back of the first playing card extending out of the lower gap, wherein the shone light is emitted from the base of the shoe and upwardly over the back of the first playing card extending out of the lower gap, or both from above and below the leading edge and top of the back of the playing card. The method may be practiced wherein the shone light is within ±100, ±70 nm 0r ±50 nm of at least one color on the back of the first playing card. The method may be practiced wherein at least two lights are shone over the back of the first playing card extending out of the lower gap, and the at least two distinct light colors/emissions differ by at least ±50 nm from each other.

The method may be practiced wherein the shone light is emitted with a visual distraction factor selected from the group consisting of fluttering light intensity, angular light movement across the back of the first playing card extending out of the lower gap, and variation in light wavelengths. The method may further include placing a set of randomized playing cards in the dealer shoe so that one surface of a forward most playing card faces the shone light.

A dealer shoe is configured to provide access to and removal of playing cards from within the dealer shoe which has:

- a base, a front plate forming a lower gap with the plate through which individual playing cards can pass, a top, and opposed sides joining the base, top, two sides and the front plate to form a card-carrying cavity,
- the front plate further comprising a light producing element configured to shine light over a back of a first playing card extending out of the lower gap; and
- the wavelength and intensity of the shone light being sufficient to reduce optical contrast of different colors and/or shades on the back of the first playing card.

The ability to know or even approximate the value of an unrevealed card in a casino table game can give the player a significant mathematical advantage. There are a number of ways this is done: such as marking the cards with a faint ink, or an ink revealed using special glasses or nicking, bending, tearing specific card values. One recent technique, commonly referred to as edge sorting, does not involve altering the cards in any way. The player observes imperfections in the manufacture of the card, specifically related to variations in size between the printed pattern on the back of the card and the white edge that surrounds it. An observant player can observe differences in thickness of less than a millimeter and use that knowledge to identify the value of the hidden card. This knowledge could affect the size of the player's initial bet in blackjack or baccarat as well as any decisions the player may make (such as choosing to hit or stay in blackjack). The present technology can assist in overcoming those deficiencies.

The design of current casino card shoes reveal the bottom edge of the card. This is necessary as the dealer must have a reasonable space available to their fingers in order to slide the next card in the shoe out with his finger. In order to protect from this form of advantage play, it is to the casino's advantage to obscure the player's ability to look at the exposed edge of the card. However, any cover or mechanical device that would physically block the player's ability to see the exposed edge would also impede the dealer's ability to efficiently remove each card from the shoe thus slowing down the speed each game is dealt.

Rather than using a physical barrier or cover to hide any visible portion of the top card in a shoe, the device obscures the player's ability to distinguish any meaningful difference in size between the back pattern on the card and the white edge by projecting a disorienting pattern on top of the exposed pattern of the back of the card sitting in card shoe. This pattern could be projected using a digital projector or a simple light source broadcast through a filter designed to alter color and pattern.

There are at least two modes (and a combination of the two modes) that may be practiced in the present technology.

Mode 1: Front-Mounted on Higher Position

A digital projector or LED, halogen lamp, fluorescent light, incandescent light or laser light is mounted above (or below, and/or below) the front surface of the shoe pointed towards the base of the shoe where the card edge is exposed to the player. The digital projector or light source could be either battery powered or powered through an electrical port/cord that runs down the long side of the shoe towards the back and connects to an electricity source in the table. The projector or light would be mounted onto the shoe so that it could be easily removed and replaced.

The digital projector would display an optically confusing light such as a stable or altering (e.g., oscillating, flickering, angularly moving) continuous image or pattern that uses the right combination of geometric shapes, color, or contrast to obscure any identifying marks visible on the exposed card in the shoe. If a light source is used, the light could be beamed through a filter or stencil placed on the front of the light-emitting device. This filter/stencil could serve two purposes: ensure the emitting light (particularly if a laser is used) does not exceed a safe level for human eyes; and also display a pattern, a pattern of bubbles or crossed lines, possibly colored red, blue, or green, which would make identifying the edge difficult.

One benefit of this design is that the light source or digital projector could be easily, quickly, and affordably replaced when necessary, the card edge could be obscured by the disorienting light pattern, and the dealer's actions removing each card from the shoe would not be impeded or in any way altered from the normal procedure.

Mode 2: Lower-Mounted Underneath the Leading Edge of the First Card.

In this variation, the projector or light source could be mounted at a lower position in front of the slot through which playing cards are withdrawn. The light may be emitted at that position by a flat panel emitter (which would not interfere with playing card withdrawal) or may be reflected at the front of the playing card removal base (or an extension thereof that extends beyond the first forward playing card in the shoe, displayed through the slot). The light source may be then originate from behind and/or underneath the platform in the shoe (and if the delivery shoe is fixed to the table, even from underneath the table through a portal and into) the delivery shoe that holds the deck of cards. An empty space already exists in the currently employed shoe models, behind the back position of the playing cards, and underneath a slide present in the bottom of the delivery shoe to gravitationally assist forward movement of the decks of playing cards. A pattern from the digital projector or the light source could be shone towards the front of the shoe and then reflected up at a backward (towards the rear of the shoe), onto the base of the back of the exposed playing card, using a reflective surface like a mirror or a refractive object such as a prism. The light would be either battery powered or powered through an electrical cord that runs out the back of the shoe. The light would be beamed through a filter to ensure the intensity of the light was at a safe level for human eyes as well as to broadcast a pattern of lines or some other distinguishing shape or color. The mirror (or light path and prism) would be angled or oriented in such a precise way as to focus or direct the light beams precisely as desired onto the card front. The reflective surface might also be textured to add an additional, disorienting pattern onto the card surface. The benefit of this model is that it takes advantage of empty space that is already part of the traditional shoe. With the exception of the emitted light, the shoe would not look significantly different from the traditional card shoe (the light might also provide an additional, appealing cosmetic benefit to the shoe's appearance).

The dealer shoe may have the front plate as opaque to mask the entire front surface of the forward most playing card while it is within the dealer shoe.

Figure 1B:
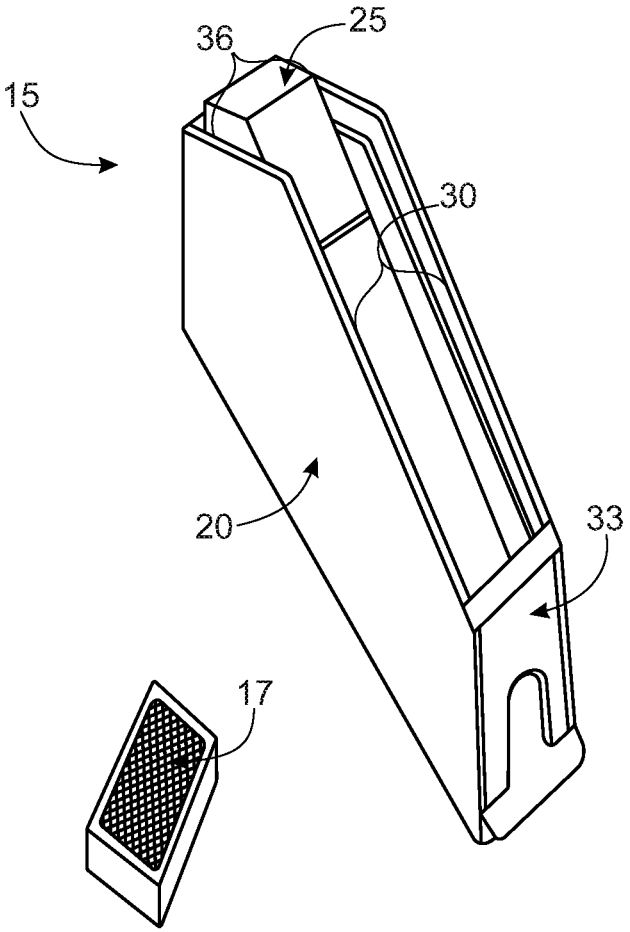
PRIOR ART FIG. 1B
FIG. 1B shows another embodiment a prior art (U.S. Pat. No. 6,402,142) embodiments (U.S. Pat. No. 6,402,142) of a dealer shoe while at rest.

FIGS. 1A and 1B show prior art embodiments (U.S. Pat. No. 6,402,142) of a dealer shoe 15. FIG. 1A shows one embodiment while in use and FIG. 1B shows another embodiment while at rest. Both FIGS. 1A and 1B show two elements of the apparatus: a base 20 and a card roller 25. While in use, the card roller 25 is in the base 20, applying a downward force on the cards 17. As shown in FIG. 1*a*, there is a vacant resting place 36 in the base 20. When not in use, as shown in FIG. 1*b*, the card roller 25 is in the resting place 36, so that the cards 17 may be easily removed, replaced, and/or shuffled.

The base 20 generally sits on a table (not shown), such as a gaming table, and has a card channel 30, a card door 33, and a resting place 36. As shown in FIG. 1*a*, while in use the card channel 30 holds playing cards 17 and the card roller 25. The card door 33 keeps the cards 17 in the card channel 30 and allows the dealer 19 to remove one card 17 at a time. The resting place 36 allows the card roller 25 to rest within the base 20 so that it does not interfere with the replacement of the cards 17. Generally, the playing cards 17 are standard playing cards used in a casino.

Referring to FIGS. 1A and 1B, in the preferred embodiment, the card roller 25 is movably connected to the base 20 and while in use is positioned within the card channel 30 of the base 20. While in use, the card roller 25 applies a downward force on the cards 17 in the card channel 30. The downward force causes the cards 17 to move downward, sliding down the ramp, so that each time an individual card 17 is removed through the card door 33, another card 17 moves into position against the card door 33. While at rest, the card roller 25 is positioned within the resting place 36, as shown by FIG. 1B. The form of the resting place 36 keeps the card roller 25 at rest until the dealer 19 (not shown) moves the card roller 25 out of the resting place 36 and into use.

Once again referring to FIGS. 1A and 1B, generally, the card roller 25 and the base 20 will be made out of the same material so as to simplify manufacturing and to reduce time and cost of manufacturing. Although plastic is preferred, both the base 20 and the card roller 25 can be made from a variety of materials including any type of metal, plastic, wood, rubber, transparent Polymeric materials (e.g., polyethylene, polycarbonate, polyacrylate) or a combination thereof.

FIGS. 1A, 1B, illustrate the method of using the prior art dealer shoe. The method for providing convenient access to and removal of cards 17 starts with the step of inserting or loading one or more decks of cards 17 in the base 20 of the dealer shoe 15, and moving the card roller 25 behind the cards 17.

Figure 2:
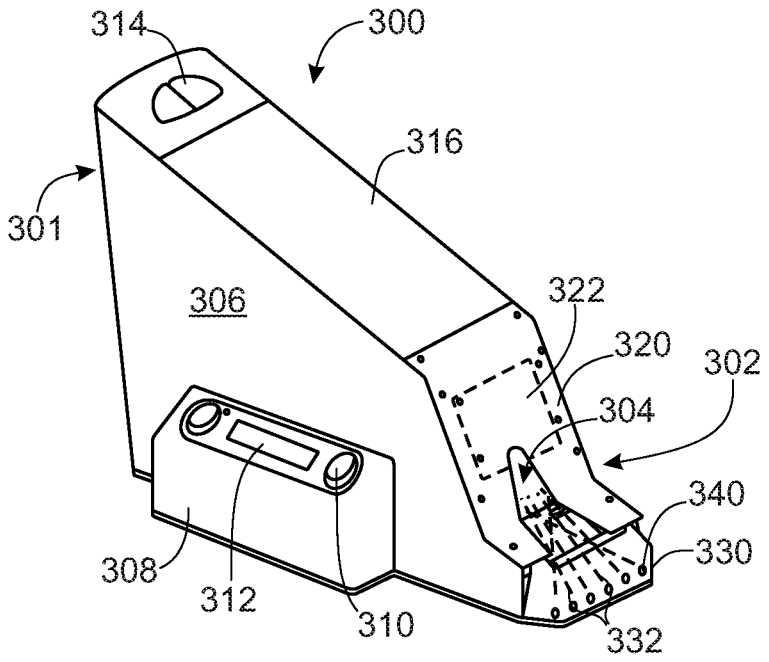
FIG. 2 shows a perspective view of a playing card delivery shoe with a lower positioned set of light emitting elements.

FIG. 2 shows an embodiment of a delivery shoe 300 according to the present technology, with the projected light 332 emitting from the lower forward portion 330 of the shoe 300.

FIG. 2 shows a perspective view of a playing card delivery shoe 300 useful within the scope of the present technology in combination with a lower positioned set of light emitting elements 340 on the forward delivery plate 330. The delivery shoe 300 is shown with its front delivery portion 302, a finger slot 304 for removal of playing cards (not shown), its back 301, side panel 306 and top panel 316 of the delivery shoe 300. A more modern mechanized shoe 300 may be provided with card delivery entry panel cover 314, side information and activation controls 308, with dealer information display 312 and activation button 310. To assist in enablement of one aspect of the present invention, the light emitting elements 340 and the beams of light emission 332 are shown. The emission panel system 340 may be any technologically available source of visible light, especially light within the range of 410-780 nm, and more preferably within the range of 420-720 nm. The emission system 340 should provide enough fluence of visible radiation that the visible radiation will mask the pattern and colors on the back of the forward-most playing card in the delivery shoe behind the front panel 320 and above the emission source 340 and then be reflected off the back surface of that forward-most playing card back to disrupt human optical capability in carefully observing printed patterns and spacing on playing cards which is often present on the backs of printed and cut (converted) playing cards in a gaming environment. These light-emitting systems 340 are part of what is referred to as the light-masking systems of the present technology within casinos. As noted, the light masking system may emit a pattern, a stable light image, a moving/flickering light image, be monochromatic or mixed color light emission system The radiation emitted from the light panel or bulb system 340 reflects off of the back of at least one playing card that has been advanced into the front end 302 of the delivery shoe 300, and may include one, two or preferably more light emitting elements 340 to mask and disrupt visual interpretation of backs of playing cards before they are removed from the delivery shoe 300. Filtered radiation (having passed through template cover (not shown) may be placed over the light-emitting elements (and may be or slid back and forth mechanically so that the transmitted from the light elements 340 further disrupt visual images of the backs of playing card information. Element 322 may be an internal lighting system that can further shine light patterns, especially flickering light patterns down the back side of playing cards and out of the finger slot hole 304.

Figure 3:
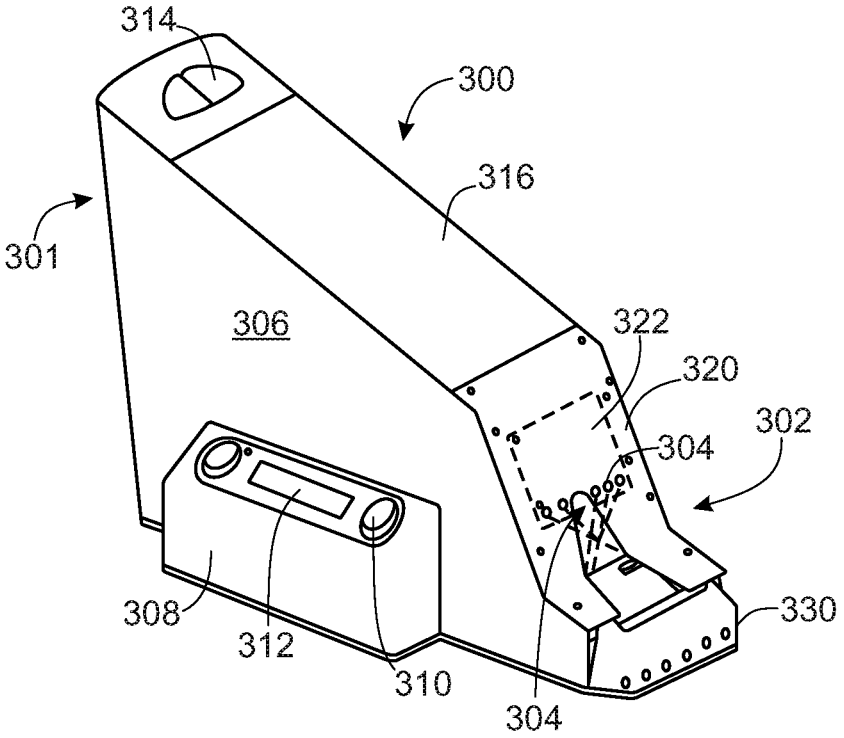
FIG. 3 shows a delivery shoe with the projected light emitting from the lights above the forward most playing card in the shoe.

FIG. 3 shows an embodiment of a delivery shoe 300 according to the present technology, with the projected light 332 emitting from the lights 340 above the forward most playing card 302 in the shoe 300. Same numbers in FIGS. 2 and 3 represent same elements, even though they may be in different physical locations (above or below the finger slot hole 304, for example). As shown in FIG. 3, the light emitting elements 340 are above the finger slot hole 304 and the emitted light 332 is shone downwardly.

The present technology additionally relates to a method for providing access to and removal of playing cards while deteriorating visually determinable information on backs of playing cards in a delivery shoe, making it more difficult for a player to obtain an advantage of foreknowledge of playing card content. The method may include steps of:

placing one or more decks of cards in a delivery shoe comprised of a base, a front plate forming a lower gap with the plate through which individual playing cards can pass, and opposed sides joining the base and the front plate, the front plate further comprising a light-emitting masking element configured to shine light over a back of a first playing card extending out of the lower gap; and the wavelength, pattern and/or intensity of the shone light being sufficient to reduce optical contrast of different colors and/or shades on the back of the first playing card.

The shone light may be in a pattern projected onto at least an exposed portion of the back of the first playing card. The shone light may be emitted from the light-emitting masking element, which may be attached on or adjacent to one portion of a side of the front plate of the delivery shoe and directed towards at least a lower area of the front plate and/or the back of the first playing card extending out of the lower gap.

An alternative method has the shone light emitted in an upward or downward direction and reflected downward or upward, respectively, over the back of the first playing card extending out of the lower gap. In either format of the dealer shoe construction, the shone light may be within ±70 nm of a color on the back of the first playing card, or may be a distinctly different wavelength.

The light-emitting masking element may be constructed as a light-emitting element, a light filter and a light focusing lens. There may be an ordered alignment of the light-emitting element, then a light filter and then a light-focusing lens within the light-emitting masking element, and at least one light is shone onto the back of the first playing card extending out of the lower gap. There may also be an ordered alignment of the light-emitting element, a first light-focusing lens and then a light filter within the light-emitting masking element, and at least one light is shone onto the back of the first playing card extending out of the lower gap. Lenses and filters may be constructed of any functional medium such as glass, crystal, polymers or other refracting material.

The method may include having the shone light emitted with a visual distraction factor selected from the group consisting of fluttering light intensity, oscillation of light patterns, angular light movement across the back of the first playing card extending out of the lower gap, patterns of shone light, and variation over time in light wavelengths. There may also be an opaque top plate at least covering top fronts of the playing cards so that no information can be seen by players from the top front edges of cards while the bottom front edges are masked. The top of the front forward plate should also be opaque.

The method is further practiced by placing a set of randomized playing cards in the dealer shoe so that one surface of a forward most playing card faces the shone light. A sensor may be positioned within the delivery shoe and the sensor senses information on a playing card back within the delivery shoe and transmits that information to a processor in communication with the sensor. The processor then may communicate with a display screen associated with the delivery shoe to display a message relating to sensed information, or the processor then communicates with light-emitting masking element and instructs the light-emitting masking element to alter its light output.

Another aspect of the present technology is a dealer shoe configured to provide access to and removal of playing cards and masking discernable information on backs of the playing cards before removal of the playing cards from within the dealer shoe which may have:

a base, a front plate forming a lower gap with the plate through which individual playing cards can pass, and opposed sides joining the base (a back) and the front plate to form a card-carrying cavity, the front plate further comprising a light-emitting masking element configured to shine light over a back of a first playing card extending out of the lower gap; and the wavelength, pattern and/or intensity of the shone light being sufficient to mask discernable information on backs of the playing cards before removal of the playing cards from within the dealer shoe by at least reducing optical contrast of different colors and/or shades on the back of the first playing card while extending out of the lower gap. There may be a nominal top to the delivery shoe/dealer shoe, but the card-carrying cavity is often exposed with no physically covering top available. The dealer shoe may be configured to have the shone light capable of being provided as a pattern on the back of the first playing card. The light(s) shone on the back may be switched among different color frequencies, within the ranges of red to violet, with even extreme degrees of wavelength shift as from red to blue and back to red, either manually or automatically.

Again in the dealer shoe, the shone light may be emitted from a light-emitting masking element attached on or adjacent to one portion of a side of the front plate of the delivery shoe and directed towards at least a lower area of the front plate where the lower gap is present to mask the back of the first playing card extending out of the lower gap.

The dealer shoe may have the light-emitting masking element comprises a light-emitting element, a light filter and a light focusing lens, wherein there may be an ordered alignment of the light-emitting element, then a light filter and then a light-focusing lens within the light-emitting masking element, and at least one light is are shone onto the back of the first playing card extending out of the lower gap.

The light-emitting masking element may be configured to emit shone light with a visual distraction factor selected from the group consisting of fluttering light intensity, angular light movement across the back of the first playing card extending out of the lower gap, patterns of shone light, and variation over time in light wavelengths.

The dealer shoe in use will have a set of randomized playing cards in the card-carrying cavity of the dealer shoe so that one surface of a forward most playing card extends out of the lower gap.

The dealer shoe may have a sensor is positioned within the delivery shoe and the sensor is configured to sense information on a playing card back within the delivery shoe and then transmit that information to a processor in communication with the sensor. The processor may be configured to communicate with a display screen associated with the delivery shoe to display a message relating to sensed information, or the processor may be configured to communicate with the light-emitting masking element and the light-emitting masking element is configured to respond to such communication by altering properties of light emitted.

Figure 4:
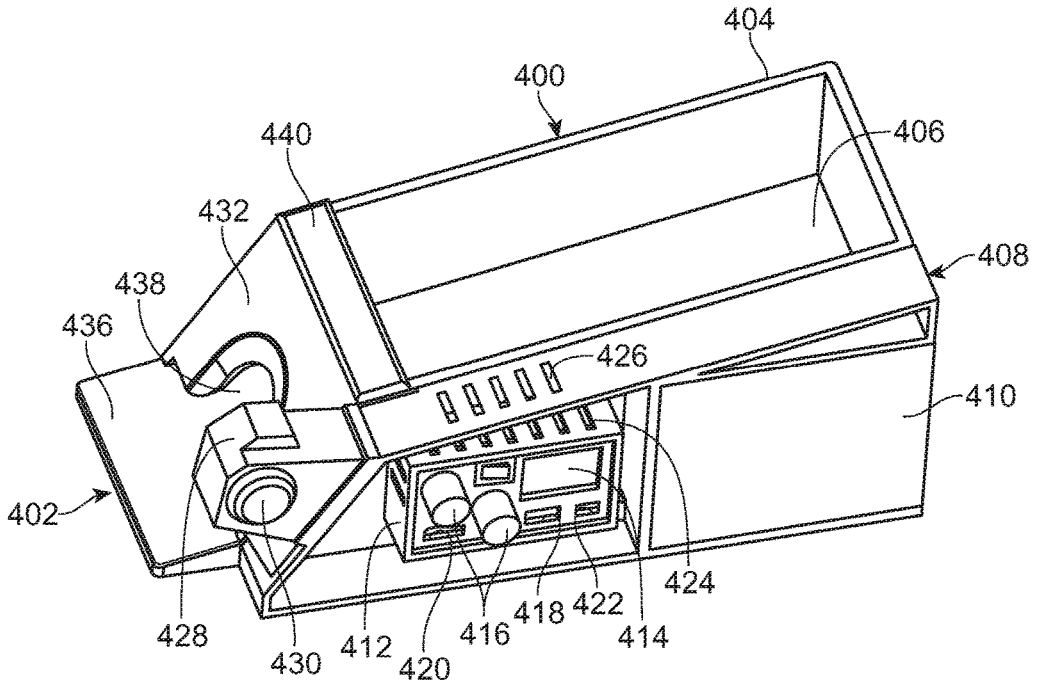
FIG. 4 shows a perspective view of the front and top of a delivery shoe according to one embodiment of the present generic invention.

FIG. 4 shows a perspective view of the front 402 and top 404 of a delivery shoe 400 according to one embodiment of the present generic invention. The delivery shoe 400 is also illustrated with a card holding volume 406 and an attached or retrofit light-masking system 408 according to one aspect of the present technology. The light-masking system 408 may be built into a new delivery shoe 400 or retrofit onto a side of an old existing delivery shoe 400. The light-masking system 408 is illustrated with a battery housing 410 (batteries not shown as within the battery housing 410), an input control panel or system 412 and the light-emitting masking element 428. Batteries (not shown) or plug-in power supply (not shown) power an at least visible light-emitting element (not shown) within the light-emitting masking element 428. Predetermined intensity, frequency, consistency, color, and direction of light emitted from the light-emitting masking element 428 can be partially controlled by input to the input control panel or system 412 (and possibly memory stored within a microprocessor (not shown) within the input control panel or system 412 so that the at least visible light emitted from the light-emitting masking element 428 is projected onto backs of playing cards (not shown) exposed from the card contact enabling opening 438 to assist in reducing the human ability to read or discern information of any type available from the back of the playing card (not shown) exposed through the opening 438 in the front card retaining plate 432. As playing cards are removed from behind the card retaining plate 432, they are slid along delivery support plate 436 and in a direction away from where light is being emitted at least partially from the light-emitting masking element 428. Top backs sides of playing cards (not shown) within the card holding volume 406 may or may not be covered by an optional top over the card holding volume 406 are also at least partially masked towards the front 402 of the delivery shoe 400 by an optional at least forward top plate 440.

The input control panel or system 412 is illustrated with two manual knob controls 416, data, I/O, USB or communication ports 418, 420, 420 and an LED (or other imaging system) display screen 414. Optional ventilation holes 424 and 426 are shown on and above *(respectively) the input control panel or system 412. An access panel or insert panel 430 is shown on the outside of the light-emitting masking element 428.

The materials for construction of structural elements of the delivery shoe 400 such as the support plate 436 the front card retaining plate 432, the optional at least forward top plate 440, top of the delivery shoe 404 and the like may be polymeric or composite or metal materials, with thermoset, thermoplastic or other rigid polymeric materials preferred.

Figure 5:
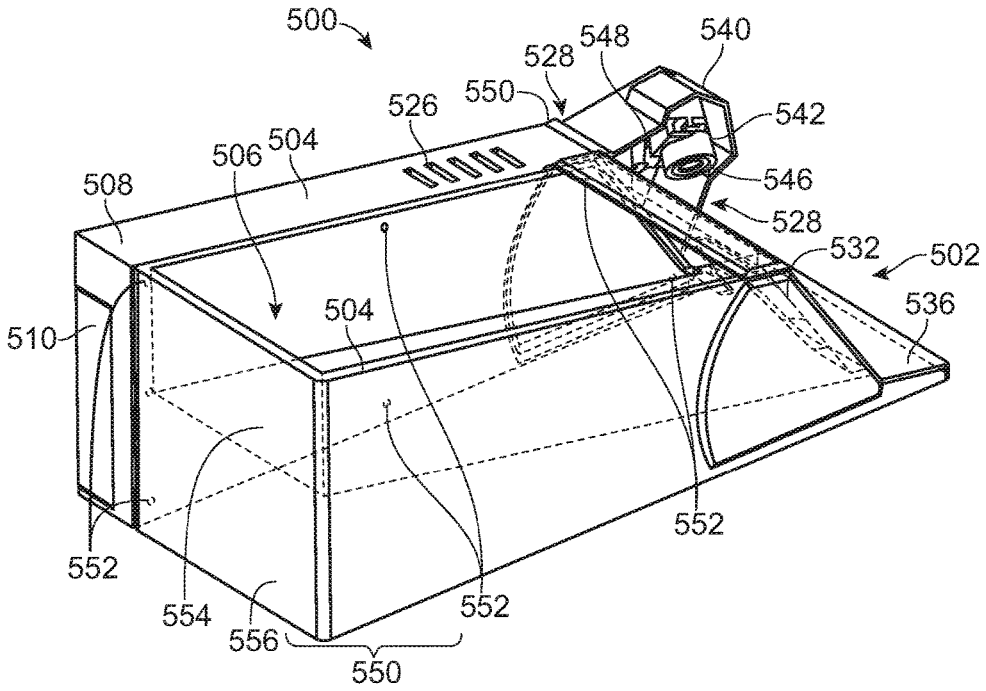
FIG. 5 shows a downward rear-side left perspective view of a delivery shoe 500 within one embodiment of the present technology.

FIG. 5 shows a downward rear-side left perspective view of a delivery shoe 500 within one embodiment of the present technology. The delivery shoe 500 is also illustrated with a card holding volume 506 and an attached or retrofit light-masking system 508 according to one aspect of the present technology. The light-masking system 508 may be built into a new delivery shoe 500 or retrofit onto a side of an old existing delivery shoe 500. The light-masking system 528 is illustrated with a battery housing 510 (batteries not shown as within the battery housing 510) and the light-emitting masking element 528. Batteries (not shown) or plug-in power supply (not shown) power an at least visible light-emitting element (not shown) within the light-emitting masking element 528.

The light-emitting masking element 528 is illustrated within one embodiment of the present invention with a cover 540 (removable or fixed within the light-emitting masking element 528), an adjustable (or fixed) light-emitting component 542 with a light-emitting end 546. The light-emitting masking element 528 is illustrated with a rotatable/adjustable capability, as through rotating and/or pivoting connection 548. If the cover 540 is removable, it may have one end snapped or otherwise fixed at joint 550 onto the top 504 of the light masking system 508 here shown retrofit onto a relatively standard delivery shoe 550. That relatively standard delivery shoe 550 is shown with a back plate 556, card holding tilted plane support 554, card holding volume 506 and top 504. The front card holding plate 532 and delivery support plate 536 are also shown. The emitted at least visible light from the light-emitting component 542 is directed from the light-emitting end 546 towards the front card holding plate 532 and delivery support plate 536. The location, angle, orientation and position of the front card holding plate 532 and delivery support plate 536 are such that emitted visible light strikes at least the lowermost forward edge of any playing cards (not shown) having at least one edge visible through or from the front card holding plate 532 to assist in masking or deteriorating readable or discernable images or content on backs of playing cards in the forward position of the delivery shoe 550. The location, angle, orientation and position of the front card holding plate 532 and delivery support plate 536 may be locked into a fixed position within the light-emitting masking element 528, may be manually adjustable (with tools rather than hands preferred), or may have a motorized (not shown) control (as from the control panel in FIG. 4) to adjust the angles and orientation in microsteps, as with a step motor or other fine motor controls. In some designs, it may be preferred to have the adjustable aspects of the light-emitting masking element 528 be locked into place by a competent technician, rather than allowing a dealer or other non-technical individual adjust the light-emitting masking element 528.

The use of a removable cover 540 can simplify repair and adjustment of the light-emitting component 542. As there may be one or more lenses, filters, emitters (bulbs) and other components that may wear out or be damaged, the removable cover 540 can be beneficial.

Figure 6:
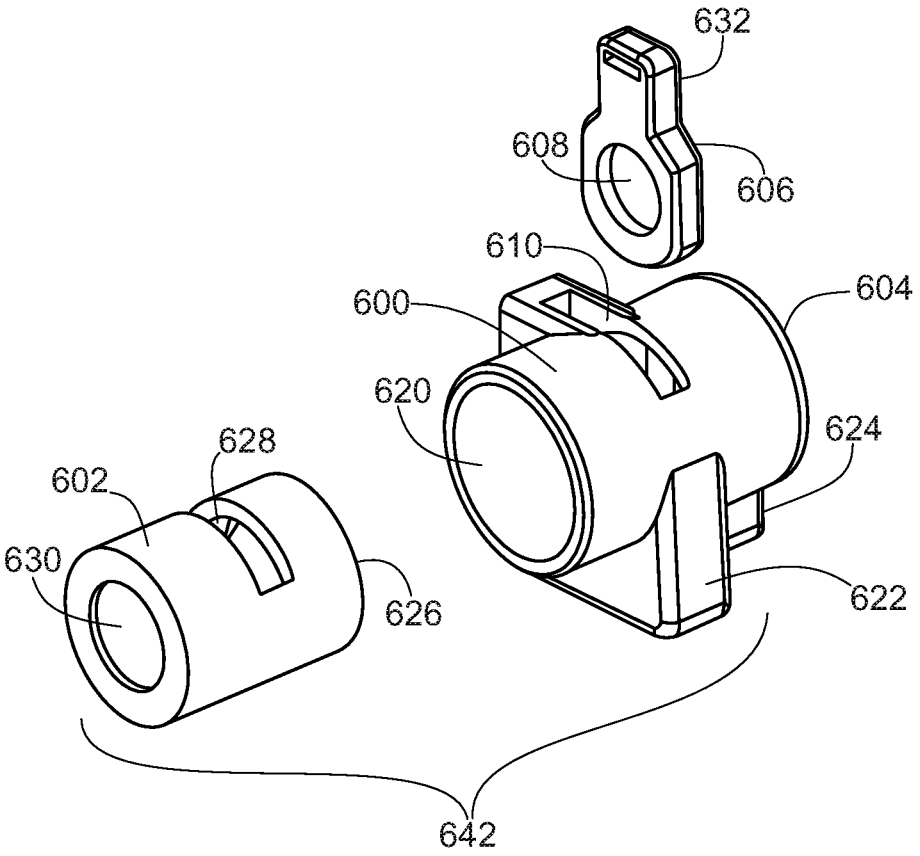
FIG. 6 shows an exploded view of a light-emitting component 642 (542 in FIG. 4).

FIG. 6 shows an exploded view of a light-emitting component 642 or projector (542 in FIG. 4). The light-emitting component 642 is shown with three distinct and replaceable elements 602 (a lens casing or housing), the light-emitter housing (and filter housing) 600 and filter-carrying handle 606. The light-emitting component 642 can be assembled by first inserting the rear end 626 of the lens housing 602 into the opening 620 in the light-emitter housing 600, then aligning the light filter receptor opening 610 in the light emitter housing 600 with the second light filter receptor opening 628 in the lens housing 602 and then inserting the filter carrying handle 606 through both the light filter receptor opening 610 in the light emitter housing 600 and the second light filter receptor opening 628 in the lens housing 602. By pushing or pulling the handle 632 of the filter carrying handle 606, the alignment of any image or pattern in the filter 608 may be adjusted so that light emitted from LED light emitters (not shown) supported on a light emitting (e.g., an LED) support back plate 604 passes through the filter 608 and into and through the lens 630 (which assists in focusing or collimating emitted light) and then onto backs of playing cards (not shown) in the delivery shoe of the present technology. The light-emitter housing 600 may be carried or supported through a base 622 which retains and supports the filter-carrying handle in an appropriate orientation and position with respect to the (for example LED) light-emitting bulbs or panels (not shown) on the light-emitting support back plate 604 and the lens 630 after the three sub-components 600, 602 and 606 are combined and the light emission is operating. A further stabilizing perpendicular (for example) arm 624 also supports the light-emitter housing 600 and may assist in connecting the sub-component light-emitter housing to other structural components (not shown) on the light-masking system 508 (e.g., of FIG. 5) or the delivery shoe (e.g., 400 of FIG. 4), either in a fixed or adjustable position.

The filter 608 may be simply a color transmitting/absorbing monochromatic or short color range filter, or may have a pattern in the absorbing/transmitting characteristics of the filter 608. The filter 608 may remain in a fixed position within the light-emitter housing 600 or (to implement an oscillation effect) the filter handle 606 may be vibrated, slid or oscillated by a motor (not shown) within the filter handle 600, or the entire light emitting component 642 can be vibrated or oscillated, as by movement of the light emitting component 642 through a vibrating or moving connector (e.g., the rotating and/or pivoting connection 548 of FIG. 5). One or more controls on the input control panel or system 412 can be used to adjust the frequency of the movement, oscillation or vibration of the light emitting 642 component or sub-components thereof.

Figure 7:
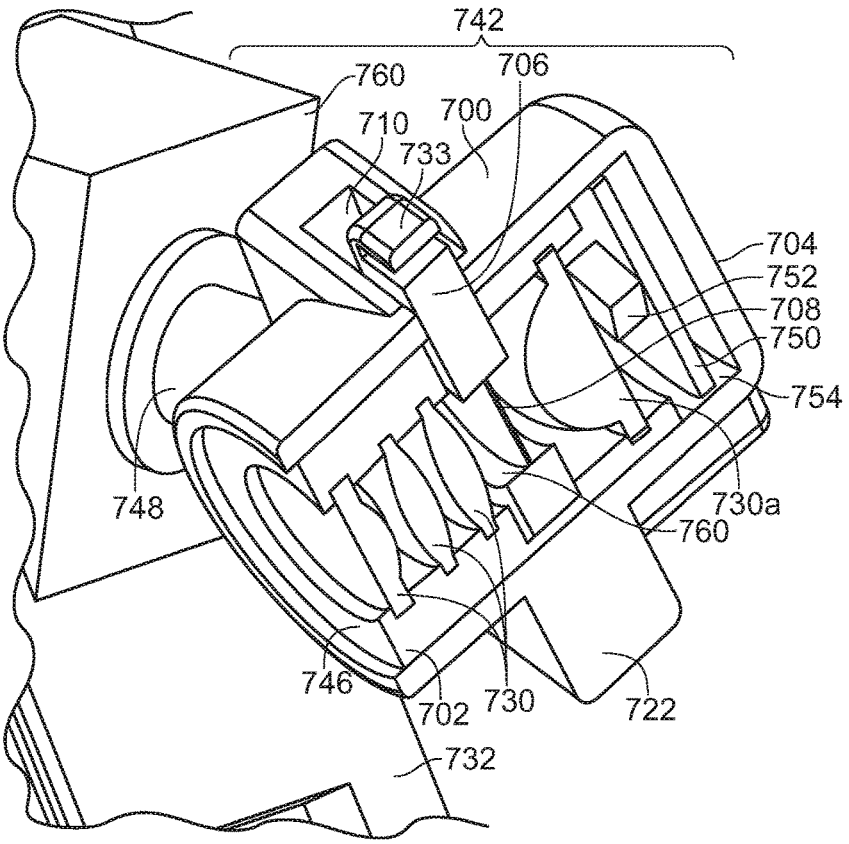
FIG. 7 is a cutaway perspective view of an adjustable (or fixed) light-emitting component 542 with a light-emitting end 546.

FIG. 7 is a cutaway perspective view of an adjustable (or fixed) light-emitting component 742 with a light-emitting end 746. An adjustable 9 at least rotating) connector 748 connects the light-emitting component 742 with a solid surface 760 which may be a part of the delivery shoe (e.g., 400 of FIG. 4) or a retrofit light-masking system (e.g., 408 of FIG. 4). A lens-carrying component 702 is shown with multiple (e.g., two, three, four or more) focusing lenses illustrated, initial focusing lens 730*a*, and three final focusing lenses 730. A single lens may be used, but this is a presently desired component as illustrated. The light filter 708 supported on the filter handle 706, with the filter between the initial focusing lends 730*a* and the three final focusing lenses 730 is shown. The light-emitting support plate 704 is shown with an internal light-emitting support plate 750 carrying a light-emitting element 752, which may be a plate, a bulb, a reflecting or light refracting element associated with another light-originating source, etc. Light would pass from the light-emitting element 752, through the initial focusing lens 730*a*, through the filter 708, through the final focusing lenses 730 and out of the front, light-emitting end 746 of the light-emitting component 742 towards the front card retaining plate 732 of the delivery shoe. A support base 722 is shown, and any space between the light-emitting support plate 704 and the internal light-emitting support plate 750 carrying a light-emitting element 752 may contain a battery power source or electrical connections to a battery or electrical outlet (none shown). A rounded surface 760 supports and controls position and movement of the filter 708 so that pressure against the handle 733 of the filter handle 706 will assist in keeping the filter 708 aligned. A groove (not shown) in the rounded surface 760 may assist in retaining desired alignment of the filter 708.

Figure 8:
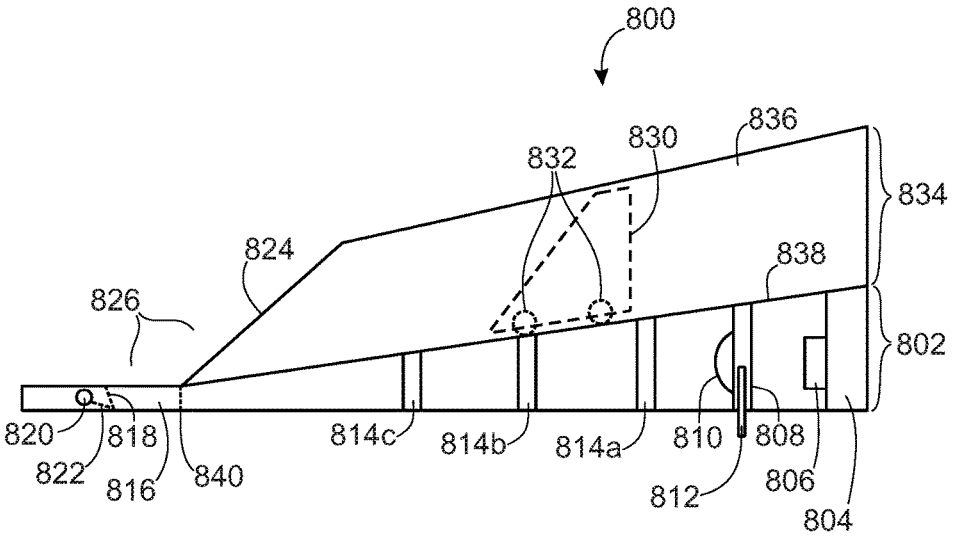
FIG. 8 shows a side view, cutaway schematic of an alternative delivery shoe 800 within the scope of the present generic invention.

FIG. 8 shows a side view, cutaway schematic of an alternative design for a delivery shoe 800 within the scope of the present generic invention. The delivery shoe 800 is illustrated with a lower component 802 and an upper component 834. The upper component 834 provides the card holding volume 836 and is shown with a standard-type card supporting and motivating gliding weight 830 on wheels 832 (optional) that is motivated by gravity to slide down the interior slope 838 within the card-holding volume 836. Playing cards (not shown) are pressed against the front delivery plate 824 where portions of the playing cards are exposed for manual grasping by a dealer. The bottoms of playing cards (not shown) are usually displayed at a region 826 at the bottom of the front delivery plate 824.

The lower component 802 comprises the light-emitting and directing system that is an aspect of the present invention. The lower portion 802 is illustrated with a light-emitting back support 804 (which may contain the power source, such as battery(s) or power inlet, not shown), the light-emitting element 806, a light-filter support, first focusing lens 810 and light-filter adjusting handle 812. The first focusing lens 810 may be between the light-emitting element 806 and the light-filter (not shown) in the light-filter support 808, either as an integrated unit or as a separate pair of components (as shown in FIG. 7, components 725 (light-emitting element), 730*a* (first focusing lens), 708 (light-filter), and 730 (the three final focusing lenses). The number of lenses in the forward section must be at least a single lens, and increasing the number along the pathway of emitted light from light-emitting element 806 through the last light-focusing lens 814*c* (after passing through light-focusing lenses 814*a* and 814*b*) increases sharpness and even intensity of the light and light image reflected off of a mirror 818 onto the region 826 at the bottom of the front delivery plate 824. The mirror 818 may be rigidly fixed within the card delivery support plate 816 or may be variable by, for example, a manual knob 820 that adjusts the mirror position through a mechanical linkage 822 to the mirror 818. The lower component 802 may be built into an original delivery shoe 800, or a relatively standard delivery shoe comprising the upper component 834 and a housing area coincident with a volume that would accept or have snapped onto the bottom of the upper component 834 a modular component comprising the lower component 802. The upper component 834 or the lower component 802 may include the card delivery support plate 816 and any included elements. The card delivery support plate 816 might actually be separately attached to either component 802 or 834 at junction 840 by mechanical fasteners (not shown) such as snaps, screws, bolts, adhesive, fusion and the like.

Figure 9:
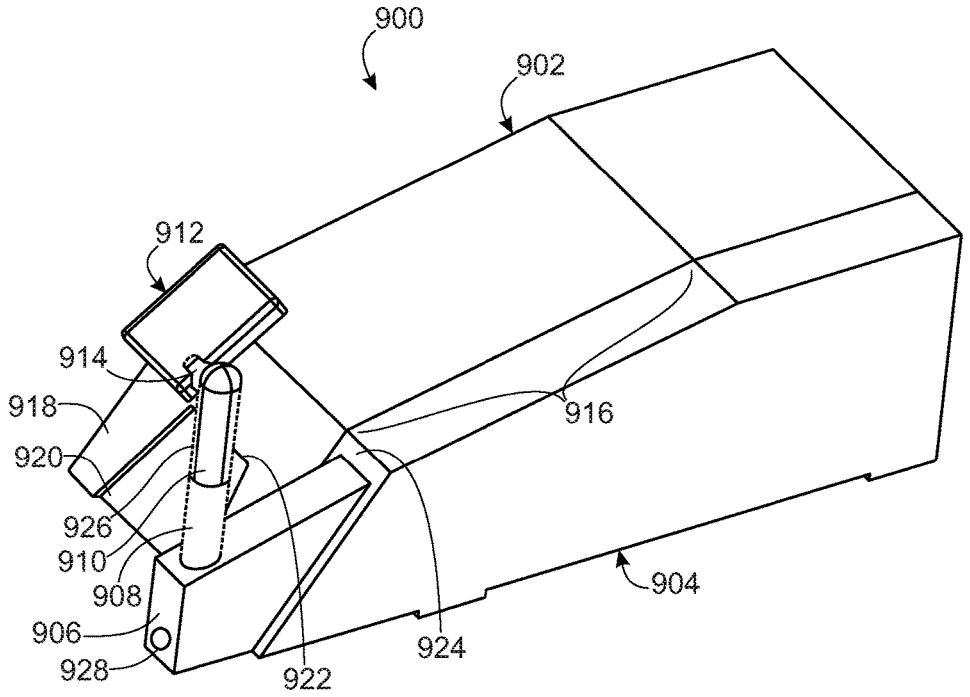
FIG. 9 shows an alternatively delivery shoe 900 within the scope of the present generic invention.

FIG. 9 shows an alternatively delivery shoe 900 within the scope of the present generic invention. This illustrated delivery shoe 900 is illustrated with a covered top 902 and a bottom and side face 904. Except for elements 906, 908, 910, 912, 914 and to a degree 916, the remaining portions of the delivery shoe 900 may be considered typical of existing delivery shoes. To assist in enabling practice of the present card back masking technology, attached to a side plate 924 on the base delivery and card carrying system (that is all elements except elements 906, 908, 910, 912, 914 and to a degree 916) is a light-emitting system which is illustrated as comprising a forward support base 906 supporting an elevated light-emitter base 908, light-emitter column top 910, adjustable connection 914, and mirror or reflecting element 912. Power for emitted light may be from batteries (not shown) stored in the delivery shoe 900, such as within the forward support base 906 or delivered through a power inlet 928. Batteries may also be present within the forward support base 906 supporting the elevated light-emitter base 908. Directed or focused light-emitting elements 926 are powered to emit light to the mirror 912 and/or directly towards the back of a playing card 920 exposed through manual removal opening 922 on the front card retaining plate 918. The adjustable connector 914 is shown with multiple degrees of orientation so that the mirror may be adjusted with respect to at least height and width of the manual removal opening 922. The elevated light-emitter base 908 and light-emitter column top 910 may be slightly angled away from the front card retaining plate 918 to reduce potential incidental contact with the dealer's hand, but the angle should not be so severe that a significant part of light from light-emitting elements 926 creates shadows passing the forward support base 906. This is one reason why it is less preferred to have the majority of light emitted from the elevated light-emitter base 908 and light-emitter column top 910 should be reflected and not direct towards the front card retaining plate 918.

Figure 10:
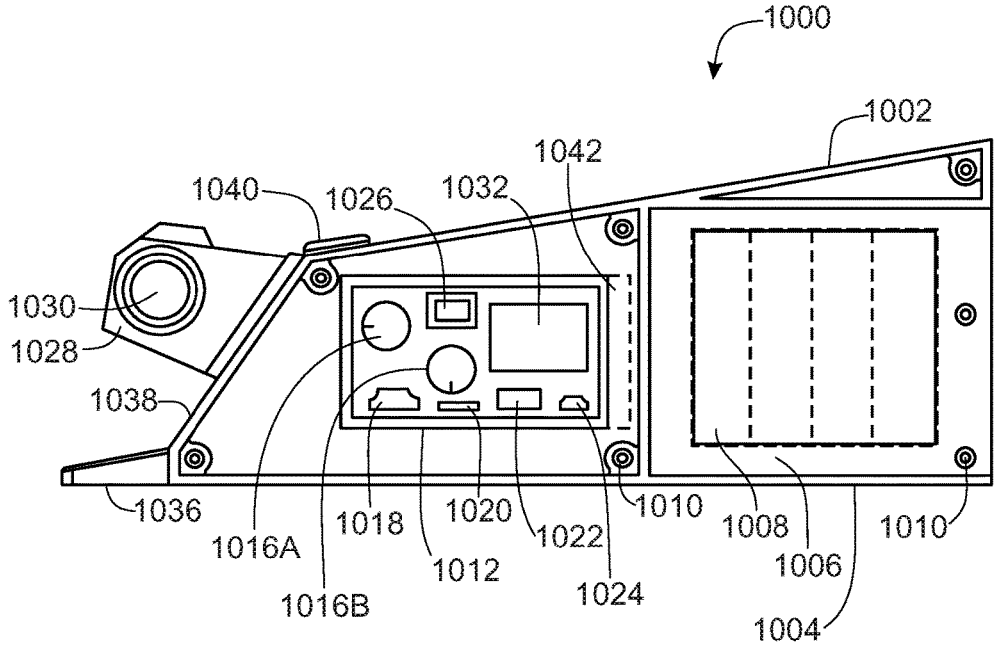
FIG. 10 shows a side view of a delivery shoe 1000 according to one embodiment within the present generic invention.

FIG. 10 shows a side view of a delivery shoe 1000 according to one embodiment within the present generic invention. A top of the shoe 1002 and bottom of the shoe 1004 are shown. A removable plate 1006 covering a storage area for batteries 1008 is shown, with some of the visible screws 1010 securing the plate 1006. A light-emitting element 1028 (as generally and previously described herein, especially with respect to FIGS. 4, 5 and 6) is shown, with the access cover 1030 to the interior of the light-emitting element 1028 shown above the playing card delivery plate 1036. Of most interest in FIG. 10 is the input panel 1012. Shown on the input panel 1012 are manual control knobs 1016*a* for light intensity control and 1016*b* an optional knob control for any of oscillation frequency, color shift, and the like. An HDMI (high definition multimedia interface) 1018 for accepting image projection data, a trans-flash (TF) card port 1020 for provision of image or reading data, a USB port 1022 and a power input port (DC or AC) 1024 are provided to the input panel (which may have backup energy storage in case of external power failure). A display panel 1032 (e.g., LED panel, liquid crystal panel, plasma panel, 7-segment display panel, etc.) is provided to display any information useful to a repairman or dealer, including power levels, battery life remaining, design information relative to card back design and/or color, number of cards delivered from an original set of playing cards in the delivery shoe, number of cards remaining to be delivered (with or without consideration of an identified 'cut' position within the original set), sensed information (e.g., position shift or light-emitter, intensity of light emitted, frequency of oscillation of emitted light, etc.) and more. An on/off button or contact panel 1026 is also shown.

One other additional feature enabled by the use of the present technology can be a card back-reading component 1040 on a front area of the delivery shoe top 1002. The card back-reading/sensing component 1040 can read and identify patterns, names or other information on backs of playing cards and transmit that information to a processor 1042 and/or to the display screen 1032. Upon reading or otherwise sensing the relevant information on the playing card back by the card back-reading component 1040 on a front area of the delivery shoe, that sensed/read information can assist in determining the nature of the light emitted towards the front card-retaining panel 1038 to assist in masking or deteriorating information of any type on the backs of exposed playing cards. For example, if the sensor detects any of a) a specific color, b) a specific pattern, c) specific pattern and color, d) casino specific playing card (e.g., MGM Grand high-stakes baccarat card, Casers Palace Blackjack Tournament card, etc.), or other information relevant to a desired light-emitting activity to best assist in deteriorating readability of the backs of the playing cards, that information may be sent to the processor 1042 for direct action or directly to the display screen 1032 or to the processor 1042 and then to the display screen 1032 to provide displayed information to the dealer/technician to appropriate manage the light and image output from the light-emitting element 1030.

For example, if the sensed information from the back of the card is RED, Bee™ brand Diamond Pattern, the light-emitter may be instructed to emit red light, a specific wavelength of red light, a specific pulsing pattern and the like. Alternatively that sensed information may be sent to the processor and the processor transmits a signal to the display panel 1032 that a filter (not shown) in the light-emitting element 1030 must be replaced with Red Filter No. 7-B, and the system will continually alert the dealer (or even provide a mechanism such as a card withdrawal lock) to prevent any card withdrawal until the filter has been replaced. Alternatively the outside top of the sensor 1040 may comprise a warning light, such that if the filter or other necessary adjustment has not been made, the warning light will glow or flash to alert the dealer as to the fact that some change in the system is needed.

Alternatively, the processor 1042 will provide a readable signal to the light-emitting element 1028 to itself change its output. The light-emitting element may contain light output control over color content (e.g., there would be a multicolor output potential in the light emitters, e.g., 752 and 806 of earlier figures) or light oscillation frequency control, and those controls would respond to the signals from the processor.

There are alternate constructions and designs within the generic scope of the present invention that can embodies within the practice of the appended claims and this application. For example, patterns projected from light elements may be similar in structure to the printed images on card backs, a memory in the shoe may store multiple images for projections to match card backs, advertising may be included in the projections, and the like.

What is claimed:

1. A method for providing access to and removal of playing cards while deteriorating visually determinable information on backs of playing cards in a delivery shoe, comprising the steps of:

placing one or more decks of cards in a delivery shoe comprised of a base, front plate forming a lower gap with the plate through which individual playing cards can pass, and opposed sides joining the base and the front plate, the front plate further comprising a light-emitting masking element configured to shine light over a back of a first playing card extending out of the lower gap; and the wavelength and intensity of the shone light being sufficient to reduce optical contrast of different colors and/or shades on the back of the first playing card.

2. The method of claim 1 wherein the shone light is in a pattern projected onto at least an exposed portion of the back of the first playing card.

3. The method of claim 2 wherein the wavelength of the shone light is within ±70 nm of a color on the back of the first playing card.

4. The method of claim 1 wherein the shone light is emitted from the light-emitting masking element attached on or adjacent to one portion of a side of the front plate of the delivery shoe and directed towards at least a lower area of the front plate and/or the back of the first playing card extending out of the lower gap.

5. The method of claim 4 wherein the wavelength of the shone light is within ±70 nm of a color on the back of the first playing card.

6. The method of claim 4 wherein the light-emitting masking element comprises a light-emitting element, a light filter and a light focusing lens.

7. The method of claim 4 wherein the shone light is emitted with a visual distraction factor selected from the group consisting of fluttering light intensity, angular light movement across the back of the first playing card extending out of the lower gap, patterns of shone light, and variation over time in light wavelengths.

8. The method of claim 6 wherein there is an ordered alignment of the light-emitting element, then a light filter and then a light-focusing lens within the light-emitting masking element, and at least one light is shone onto the back of the first playing card extending out of the lower gap.

9. The method of claim 6 wherein there is an ordered alignment of the light-emitting element, a first light-focusing lens and then a light filter within the light-emitting masking element, and at least one light is shone onto the back of the first playing card extending out of the lower gap.

10. The dealer shoe of claim 7 wherein the shone light is capable of being provided as a pattern on the back of the first playing card.

11. The method of claim 1 wherein the shone light is emitted in an upward direction and reflected downward over the back of the first playing card extending out of the lower gap.

12. The method of claim 1 wherein the shone light is within ±70 nm of a color on the back of the first playing card.

13. The method of claim 1 wherein the shone light is emitted with a visual distraction factor selected from the group consisting of fluttering light intensity, angular light movement across the back of the first playing card extending out of the lower gap, patterns of shone light, and variation over time in light wavelengths.

14. The method of claim 1 further comprising placing a set of randomized playing cards in the dealer shoe so that one surface of a forward most playing card faces the shone light.

15. The dealer shoe of claim 14 wherein the shone light is emitted from a light-emitting masking element attached on or adjacent to one portion of a side of the front plate of the delivery shoe and directed towards at least a lower area of the front plate where the lower gap is present to mask the back of the first playing card extending out of the lower gap.

16. The dealer shoe of claim 15 wherein the light-emitting masking element comprises a light-emitting element, a light filter and a light focusing lens.

17. The dealer shoe of claim 16 wherein there is an ordered alignment of the light-emitting element, then a light filter and then a light-focusing lens within the light-emitting masking element, and at least one light is are shone onto the back of the first playing card extending out of the lower gap.

18. The dealer shoe of claim 16 wherein there is an ordered alignment of the light-emitting element, a first light-focusing lens and then a light filter within the light-emitting masking element, and at least one light is are shone onto the back of the first playing card extending out of the lower gap.

19. The dealer shoe of claim 16 wherein the light-emitting masking element is configured to emit shone light with a visual distraction factor selected from the group consisting of fluttering light intensity, angular light movement across the back of the first playing card extending out of the lower gap, patterns of shone light, and variation over time in light wavelengths.

20. The method of claim 1 wherein a sensor is positioned within the delivery shoe and the sensor senses information on a playing card back within the delivery shoe and transmits that information to a processor in communication with the sensor.

21. The method of 20 wherein the processor then communicates with a display screen associated with the delivery shoe to display a message relating to sensed information.

22. The method of 20 wherein the processor then communicates with light-emitting masking element and instructs the light-emitting masking element to alter its light output.

23. A dealer shoe configured to provide access to and removal of playing cards and masking discernable information on backs of the playing cards before removal of the playing cards from within the dealer shoe comprising:

a base, a front plate forming a lower gap with the plate through which individual playing cards can pass, and opposed sides joining the base and the front plate to form a card-carrying cavity, the front plate further comprising a light-emitting masking element configured to shine light over a back of a first playing card extending out of the lower gap; and the wavelength and intensity of the shone light being sufficient to mask discernable information on backs of the playing cards before removal of the playing cards from within the dealer shoe by at least reducing optical contrast of different colors and/or shades on the back of the first playing card while extending out of the lower gap.

24. The dealer shoe of claim 23 wherein the shone light is emitted upwardly and then reflected downwardly over the back of the first playing card extending out of the lower gap.

25. The dealer shoe of claim 23 wherein the shone light is within ±70 nm of a color on the back of the first playing card.

26. The dealer shoe of claim 23 wherein the light-emitting masking element is configured to emit shone light with a visual distraction factor selected from the group consisting of fluttering light intensity, angular light movement across the back of the first playing card extending out of the lower gap, patterns of shone light, and variation over time in light wavelengths.

27. The dealer shoe of claim 23 further comprising a set of randomized playing cards in the card-carrying cavity of the dealer shoe so that one surface of a forward most playing card extends out of the lower gap.

28. The dealer shoe of claim 23 wherein a sensor is positioned within the delivery shoe and the sensor is configured to sense information on a playing card back within the delivery shoe and then transmit that information to a processor in communication with the sensor.

29. The dealer shoe of claim 28 wherein the processor is configured to communicate with a display screen associated with the delivery shoe to display a message relating to sensed information.

30. The dealer shoe of claim 28 wherein the processor is configured to communicate with the light-emitting masking element and the light-emitting masking element is configured to respond to such communication by altering properties of light emitted.

* * * * *